United States Patent [19]

Berg

[11] 4,162,068

[45] Jul. 24, 1979

[54] DEVICE FOR ARM WRESTLING

[76] Inventor: Mark J. Berg, 1420 E. 6th St., Superior, Wis. 54880

[21] Appl. No.: 820,726

[22] Filed: Aug. 1, 1977

[51] Int. Cl.[2] ..... A63B 67/00; A63F 9/00

[52] U.S. Cl. ..... 273/1 E

[58] Field of Search ..... 273/1 E, 1 R, 179 A

[56] References Cited

U.S. PATENT DOCUMENTS

| | | | |
|---|---|---|---|
| 3,467,376 | 9/1969 | Feinberg | 273/1 R |
| 3,467,389 | 9/1969 | Scholin et al. | 273/179 A |
| 3,735,983 | 5/1973 | Ortiz | 273/1 E |

*Primary Examiner*—Paul E. Shapiro
*Attorney, Agent, or Firm*—Wicks & Nemer

[57] ABSTRACT

A device for arm wrestling including a base having a pair of elbow pads adjustably mounted on the top of the base. The base has a wing pivotally mounted on each side of the base. A source of electrical power and a bell connected thereto. A switch is carried by the base adjacent each wing member and connected to the bell. Each wing has a flange for actuating the switch to ring the bell when the wing is pivoted to a predetermined position.

6 Claims, 6 Drawing Figures

DEVICE FOR ARM WRESTLING

SUMMARY

The invention relates to an improvement in a device for use in arm wrestling. In arm wrestling the participants place their elbows upon a surface with arms uplifted and hands clasped. Each participant attempts to force the other's arm downwardly to the surface. However, a complete downward position of an arm is sometimes difficult to determine before the arm is again raised.

It is an object of the invention to provide a device including a base having a wing pivotally mounted on each side of the base, each wing having an extension which contacts a switch which in turn rings a bell when the wing assumes a predetermined position. As a result an arm "down" position is positively and accurately determined.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
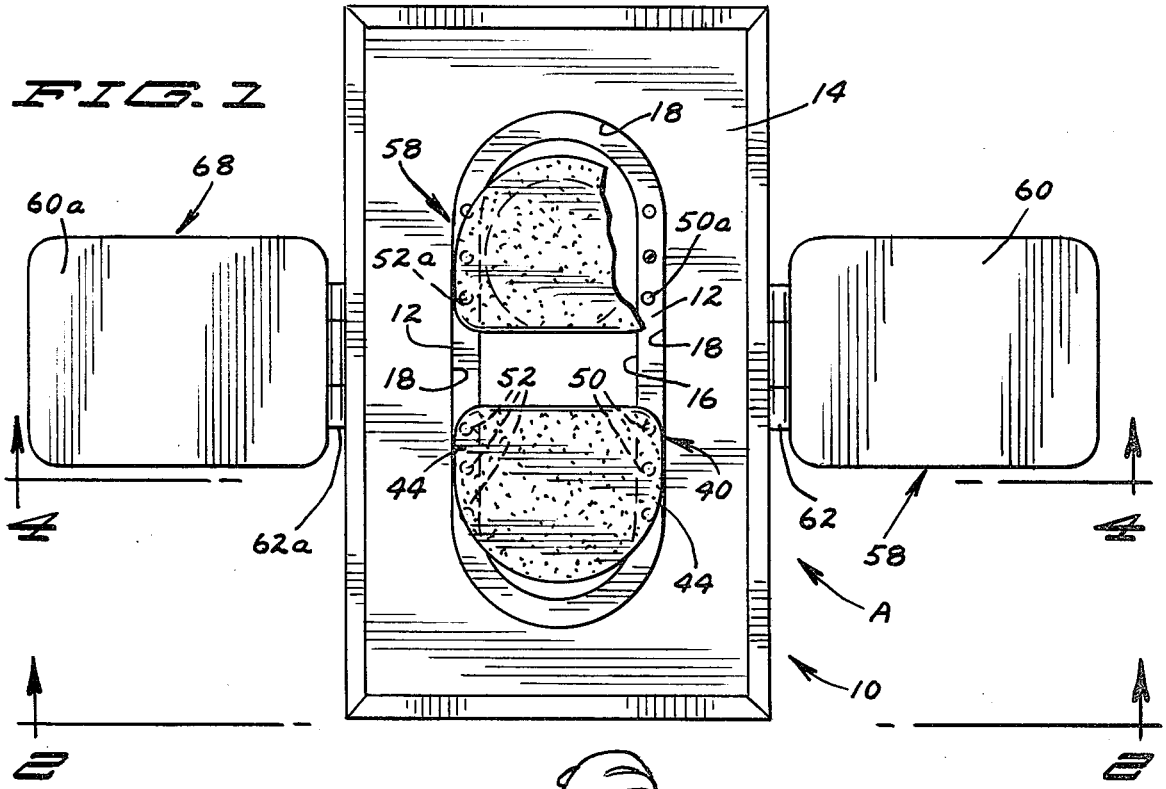
FIG. 1 is a top plan view of a device for arm wrestling and embodying the invention.

Referring to the drawings in detail, the device for arm wrestling A includes the base 10. The base 10 includes the top 12 to which is secured the sheet of sponge rubber padding 14 or the like. The top 12 is formed with the elongated opening 16 which is semi-circular at each end. The padding 14 is short of the periphery of the opening 16 thereby forming the peripheral recess 18 the bottom of which is the top 12.

The base 10 also includes the end walls 20 and 22 and the sidewalls 24 and 26 all of which depend from the top. Extending between the connected to the sidewalls 24 and 26 are the supports 28 and 30. Mounted on and extending downwardly from the support 28 are the suction cups 32 and 34, and mounted on and extending downwardly from the support 30 are the suction cups 36 and 38.

The numeral 40 designates a first elbow support which includes the cup formation 42 formed with flange 44 which extends partially around the upper edge of the cup formation for engagement in the recess 18 and upon the top 12 thereby supporting the elbow support 40 within the opening 16 of the top of the device. The flange of the support 40 has extending therefrom the pins 46 and 48 which are received in any of the holes 50 and 52, respectively, whereby the elbow supports may be adjustably positioned on the base as desired by the users of the device. The cup formation 42 is filled with a sponge-like material 54 on which the elbow is positioned which is covered with the sheet member 56. A second elbow support 58 is provided which is identical to support 40 with like parts bearing like reference numerals but accompanied by a lower case letter a.

The numeral 58 designates a first wing member which includes the flat board 60 to which is connected the hinge 62. The hinge 62 is also connected to the side wall 24. Secured to the underside of the board 60 is the flange 64 which contacts the conventional first spring loaded switch 66 mounted in the sidewall 24. The switch 66 is wired to a source of electrical power in battery B and an indicator in the form of bell Be by conventional means. A second wing member 68 is provided which is identical to first wing 58 with like parts bearing like reference numerals but accompanied by a lower case letter a.

Also provided is a second spring loaded switch 70 mounted in the sidewall 26 contacted by the flange **64*a* mounted on the underside of the wing board 60*a*. The switch 70 is wired to the battery B and the bell Be by conventional means. Secured to the underside of the wing board 60 is the stop 72 which has the rubber end member 74, the stop 72 limiting the downward hinged movement of the wing 58** by contact with a hard surface S on which the device is positioned.

Secured to the underside of the wing board **60*a* is the stop 76 which has the rubber end member 78, the stop 76 limiting the downward hinged movement of the wing 60*a* by contact with a hard surface S on which the device is positioned. The wings 58 and 68 may be hingedly moved to a position substantially overlying the top 14** of the device for easier storage.

Figure 2:
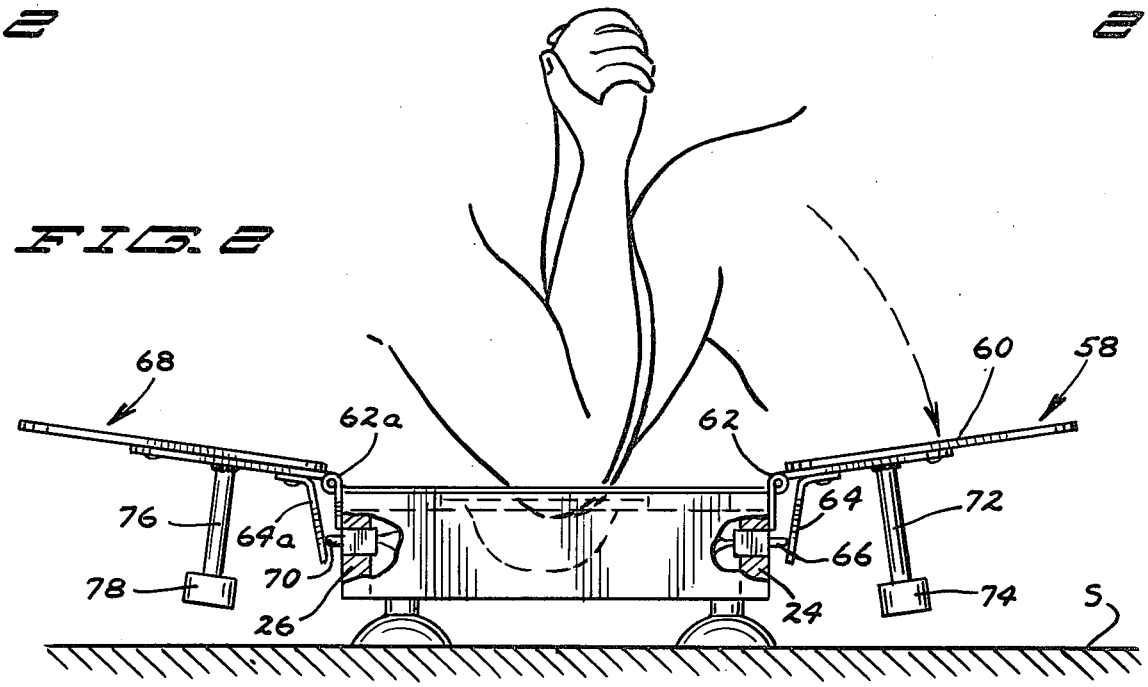
FIG. 2 is an end view on the line 2—2 of FIG. 1, portions thereof being broken away and illustrating two human arms in the starting position of arm wrestling.
Figure 3:
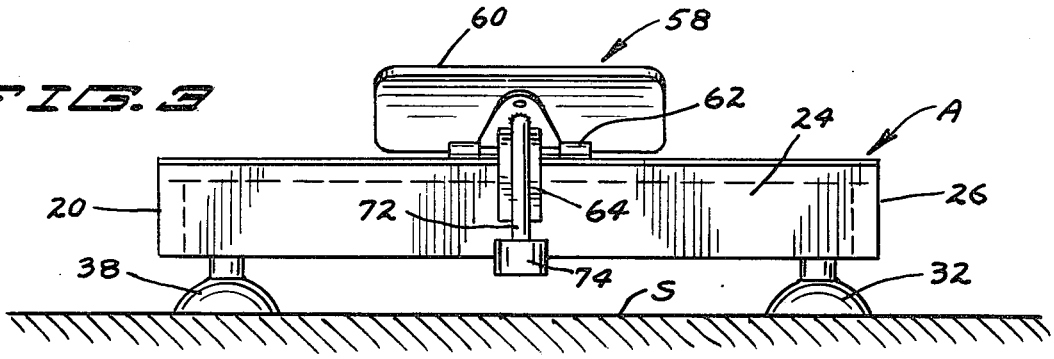
FIG. 3 is a side elevational view of the device.
Figure 4:
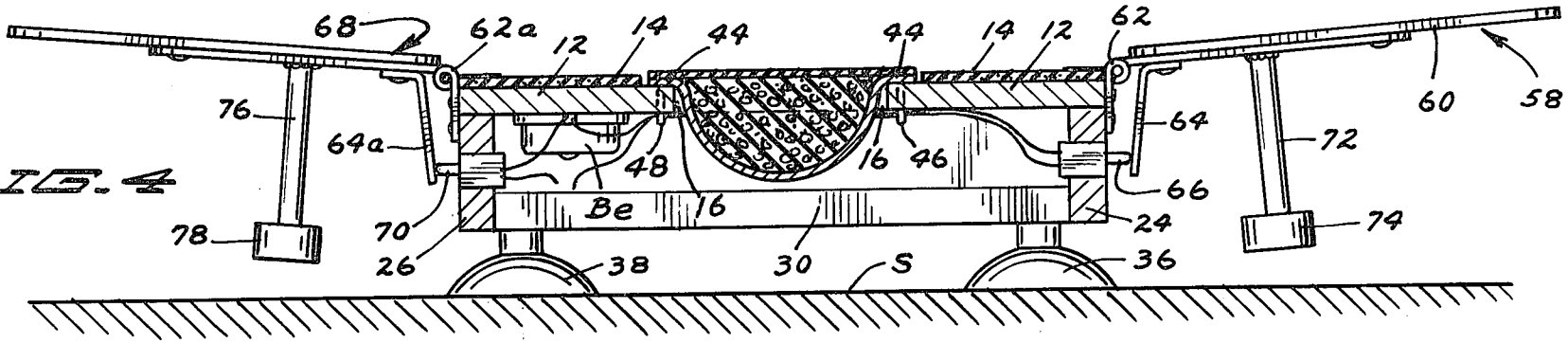
FIG. 4 is a transverse sectional view on the line 4—4 of FIG. 1.
Figure 5:
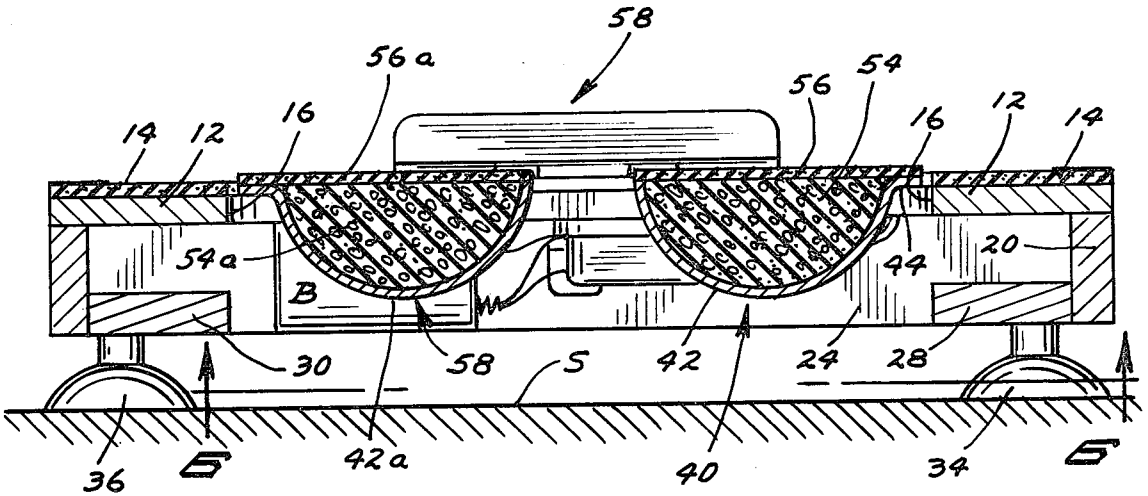
FIG. 5 is a longitudinal sectional view thereof.
Figure 6:
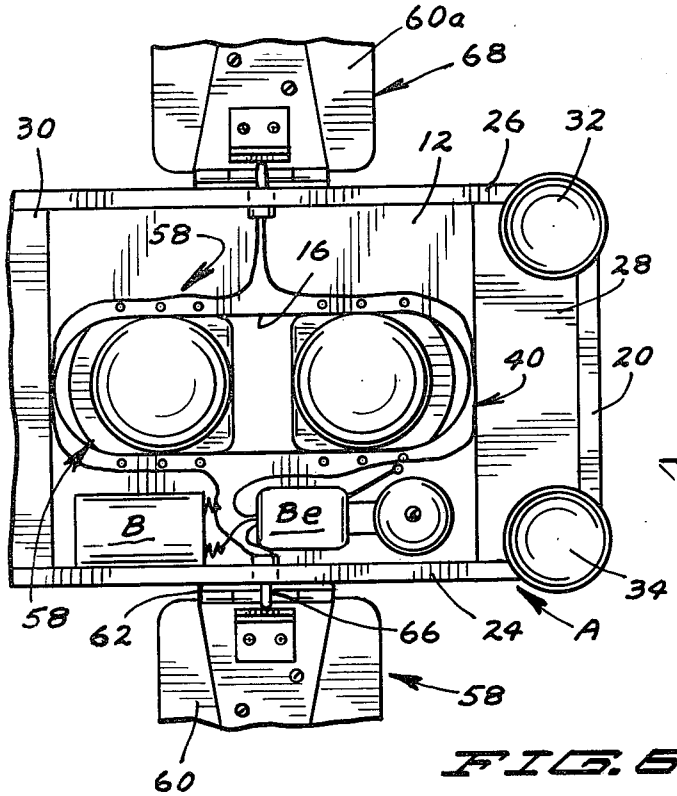
FIG. 6 is a bottom plan view on the line 6—6 of FIG. 5.

In using the device A, the same is securely positioned on a firm surface by means of the suction cups with the wings 58 and 68 in the outwardly extended positions as in the drawing figures. Then the arm wrestling participants assume positions opposite the ends of the device with each participant having his elbow in an elbow support 40 or 58 with hands clasped as in FIG. 2. As hereinbefore noted the elbow supports 40 and 58 may each be adjustably positioned by means of the pins 46 and 48 in the holes 50, 52, **50*a* and 52*a***.

As the act of arm wrestling progresses one of the participants forces the arm of the other participant to a horizontal position upon a wing 58 or 68 sufficiently so that the accompanying switch 66 or 70 is actuated thereby ringing the bell Be. With such a device the bell is rung when the arm is in the substantially horizontal or "down" position and there is no guessing as to when that "down" position is attained which indicates the winner and loser in the game of arm wrestling.

Having thus described the invention, what is claimed as new and desired to be secured by Letters Patent is:

1. A device for use in arm wrestling comprising:

(a) a substantially flat top base having a rectangular formation with parallel opposed first and second spaced depending side portions and parallel opposed first and second spaced depending end portions, (b) a first wing member pivotally mounted at one end thereof to said first side portion of said base substantially centrally thereof and normal thereto, (c) a second wing member pivotally mounted at one end thereof to said second side portion of said base substantially centrally thereof and normal thereto, (d) a first switch carried by said first side portion in alignment with said first wing portion, (e) a second switch carried by said second side portion in alignment with said second wing portion, (f) a first flange connected to the underside of said first wing member in alignment with said first switch adapted to actuate said first switch when said first wing member is pivotally moved to a predetermined position, (g) a second flange connected to the underside of said second wing member in alignment with said second switch adapted to actuate said second switch when said second wing member is pivotally moved to a predetermined position, (h) means carried by the top of said base on which the elbows of each of two arm wrestling participants are positioned and supported, (i) stop means carried by the underside of each of said wing members and extending downwardly thereof for limiting the downward pivotal movement thereof, (j) electrically operated indicator means carried by said base and connected to a source of power and actuated by either or both of said first and second switches when the switches are actuated by either or both of said first and second flanges of said wing members.

2. The device of claim 1 in which said elbow positioning means includes (a) a first support pad and (b) a second support pad.

3. The device of claim 2 further characterized by means for adjustably positioning each of said first and second support pads relative to said wing members and said base.

4. The device of claim 3 in which said support pads extend into a recess formed in said base.

5. The device of claim 4 in which said means for adjustably positioning said support pads relative to said wing members includes (a) pegs formed on said support pads engageable in (b) holes formed in said base.

6. The device of claim 5 in which said stop means carried by each of said wing members includes an extension extending from each of said wing members for contact with a surface on which the device is positioned.

* * * * *